United States Patent [19]

Kessler et al.

[11] 4,279,366

[45] Jul. 21, 1981

[54] ROLLER SKATE CARRIER

[76] Inventors: Milton Kessler, 6690 Harrington Ave., Youngstown, Ohio 44512; Ronald N. Kessler, 1161 Monsell Dr., Youngstown, Ohio 44505

[21] Appl. No.: 141,346

[22] Filed: Apr. 18, 1980

Related U.S. Application Data

[63] Continuation-in-part of Ser. No. 76,191, Sep. 17, 1979.

[51] Int. Cl.[3] ..... B65D 71/00

[52] U.S. Cl. ..... 294/162; 294/16; 12/120.5; 294/166

[58] Field of Search ..... 224/45 P, 45 Q, 45 S, 224/45 T; 211/34; 294/15, 16, 26, 28, 86 H, 87 R, 87.22, 97, 99 S; 280/811; 12/120.5

[56] References Cited

U.S. PATENT DOCUMENTS

| | | | |
|---|---|---|---|
| 1,645,839 | 10/1927 | Westerfield | 224/45 P |
| 1,692,958 | 11/1928 | Stahl | 224/45 P |
| 3,397,416 | 8/1968 | Celli | 12/120.5 |
| 4,186,956 | 2/1980 | Flynn | 294/16 |

*Primary Examiner*—Steven M. Pollard
*Attorney, Agent, or Firm*—Burge & Porter Co.

[57] ABSTRACT

A carrier for releasably receiving, retaining, carrying and hanging a pair of roller skates includes a C-shaped handle having upper and lower leg portions which overlie each other and which extend substantially in a common plane. The upper leg portion is of sufficient size relative to the size of one's hand to effectively distribute the load of a pair of roller skates across the width of one's hand. The lower leg portion is provided with an opening through which a shaft extends in a direction substantially perpendicular to at least a part of the lower leg portion. Opposite end regions of the shaft project from opposite sides of the opening. Two separate pairs of hook-shaped arm members are carried on opposite end regions of the shaft. Each pair includes arm members located on opposite sides of the C-shaped handle for engaging a rear axle of a skate. The arm members of each pair are spring biased in directions relatively away from each other, but may be moved relatively toward each other as required for the arm members to be inserted between the inside surfaces of a pair of skate wheels. The shaft is rotatable with respect to the C-shaped handle thereby enabling the arm members to be moved in unison between a storage position wherein they overlie opposite sides of the handle, and an operative position wherein they depend from the handle. A detent assembly is interposed between the shaft and the handle to selectively releasably retain the arm members in their operative and storage positions.

11 Claims, 12 Drawing Figures

ROLLER SKATE CARRIER

CROSS-REFERENCE TO RELATED APPLICATION

The present application is a continuation-in-part of application Ser. No. 76,191 filed Sept. 17, 1979 entitled COAT HANGER CARRIER, referred to hereinafter as the "Carrier Patent," the disclosure of which is incorporated herein by reference.

BACKGROUND OF THE INVENTION

1. Field of the Invention

The present invention relates generally to a roller skate carrier for releasably receiving, retaining, carrying and hanging a pair of roller skates when they are not in use.

2. Prior Art

The problem of providing a relatively simple and inexpensive means for transporting a pair of roller skates and/or for hanging skates to store them has not been adequately solved by prior proposals. While carrying cases and various other devices have been proposed to facilitate the transportation and storage of roller skates, devices embodying prior proposals have suffered from drawbacks such as being unduly large in size, inconvenient to use and expensive to make.

One recent proposal has provided an essentially three-part structure formed from plastics material having a handle with a finger-grip slot formed therethrough. A pair of relatively complexly configured arm members, each having two integrally formed hook-shaped portions, are movably connected to the handle by a shaft. The shaft is formed integrally with one of the double-hook-shaped arm members, extends through a hole formed in the handle, and is received in a hole formed in the other of the double-hook-shaped arm members.

One problem with a skate carrier of the type embodying this recent prior proposal is that the complexly configured double-hook-shaped arm members directly abut opposite sides of the handle and cannot be moved relatively inwardly along the shaft to permit their hook-shaped arms to be received between inside surfaces of a pair of relatively closely spaced skate wheels. Accordingly, such a carrier is not adjustable for use with skates of a wide variety of sizes. Moreover, if the hook-shaped arms of one pair are deformed toward each other in an effort to permit these arms to be inserted between the inner wheel surfaces of the rear wheels of one skate, the other arms of the other pair are caused to bend correspondingly away from each other thereby rendering more difficult the later deformation of these other hook-shaped arms when one wants to fit them between the inner wheel surfaces of the rear wheels of the other skate.

A further deficiency of the recent prior skate carrier proposal is the manner in which a detent is attempted to be formed between the double-hook-shaped arm members and the handle of the carrier. The handle is provided with a single recess into which a projection formed on one of the arm members is intended to extend when the arm members are positioned to overlie the handle. The operation of this detent is not as effective as is desired.

Still another problem with the recent prior proposal is that its single detent is not configured to assist in any way in holding the double-hook-shaped arm members in their extended, operational positions. Accordingly, when one attempts to use the carrier to transport a pair of skates, there is a tendency for the double-hook-shaped arm members to oscillate relative to the handle as one walks with one's arm swinging in a pendulum-type of movement, whereby the skates are not carried in as controlled an attitude as one would desire.

3. The Referenced Carrier Patent

The invention described in the referenced Carrier Patent addresses the problem of providing a novel and improved carrier for use with a garment bag wherein an array of hanger hook portions project from the upper end of the garment bag and must be held together and supported in order to carry the garment bag. The Carrier Patent is of interest only inasmuch as the C-shaped handle described therein is much like the C-shaped handle used with the skate carrier of the present invention.

A carrier embodying the preferred practice of the Carrier Patent invention includes a substantially C-shaped member having upper and lower leg portions which overlie each other and which extend substantially in a common plane. The upper leg portion is of sufficient size and cross section relative to the size of one's hand to effectively distribute the weight of heavily loaded hangers across the width of one's hand. The lower leg portion has a hanger-hook receiving structure defining an opening for releasably receiving and retaining hanger hook portions with their associated hangers extending substantially within the common plane. The receiving structure is located at a position approximately below the center of gravity of the upper leg portion so that the upper leg portion will tend to uniformly load such portions of one's hang as engage it. Carriers of this type enable one to comfortably transport heavily loaded garment bags without excessively stressing one or two fingers as commonly occurs when one tries to directly carry several heavily loaded coat hangers.

The invention of the referenced Carrier Patent does not address the problem of providing a carrier for releasably receiving, retaining, carrying and hanging a pair of roller skates. While handle portions of the invention described in the referenced Carrier Patent are configured much like handle portions employed in the preferred practice of the present invention, the carrier described in the Carrier Patent is not suitable for use with roller skates.

SUMMARY OF THE INVENTION

The present invention overcomes the foregoing and other drawbacks of the prior art by providing a novel and improved roller skate carrier for releasably receiving, retaining, carrying and hanging a pair of roller skates, and for distributing the weight of a pair of roller skates across the width of one's hand to enable the skates to be comfortably carried.

A roller skate carrier embodying the preferred practice of the present invention includes a substantially C-shaped handle having upper and lower leg portions which overlie each other and which extend substantially in a common plane. The upper leg portion is of sufficient size and cross section relative to the size of one's hand to effectively distribute the weight of a pair of roller skates across the width of one's hand. The lower leg portion has an opening extending therethrough in a direction substantially perpendicular to at least a part of the lower leg portion. A shaft extends through the opening. Two pairs of hook-shaped arm members are carried on the shaft. Each pair includes an outer arm member located on one side of the handle, and an inner arm member located on the other side of the handle. All four of the hook-shaped arm members are loosely coupled to the shaft and may be moved relative to the shaft and to each other. The inner arm member of one pair abuts the outer arm member of the other pair. Each inner arm member is biased outwardly by a separate spring interposed between it and the handle. By virtue of this unique mounting arrangement, the four hook-shaped arm members can be moved individually or in pairs as may be needed to engage the rear axles of skates of a wide variety of sizes.

A feature of the present invention lies in the provision of a roller skate carrier which can be releasably secured to a pair of roller skates and which, when utilized to carry a pair of roller skates, will present no sharp edges or corners to cause discomfort to the person using the carrier.

A further feature of the invention lies in the provision of a roller skate carrier which can be fabricated sufficiently inexpensively so that it can be sold for a relatively low price or given away as a sales promotion item. The body of the carrier is preferably molded as a single piece and is formed from inexpensive plastics material. The shaft and the four arm members are likewise formed as molded plastics pieces and, in view of the simplicity of their configurations, can be formed inexpensively. A significant feature indeed lies in the fact that the four hook-shaped arm members of the carrier are identical one with another, thereby enabling all of these members to be formed in one inexpensive single-cavity mold, if so desired.

Still another feature lies in the provision of a roller skate carrier which can be hung on a hook or a coat rod for storing either the carrier itself or for storing a pair of skates.

Another feature lies in the provision of a roller skate carrier having hook-shaped arm members which are movable relative to the handle of the carrier between an operating position wherein they depend from the handle, and a storage position overlying opposite sides of the handle. When the arm members are in their storage position, the overall size of the carrier is diminished sufficiently to enable the carrier to be stored in one's pocket. A virtue of the carrier's being able to fit in one's pocket is that a skater can keep the carrier safely in his possession while wearing his skates.

Yet another feature lies in the provision of a roller skate carrier having an improved detent mechanism which operates not only to releasably retain the hook-shaped arm members in their storage position but also to provide a strong and effective detent which will releasably retain the hook-shaped arm members in their operative position.

A fuller understanding of these and other features of the invention will be had by referring to the following description and claims taken in conjunction with the accompanying drawings.

DESCRIPTION OF THE PREFERRED EMBODIMENT

Figure 1:
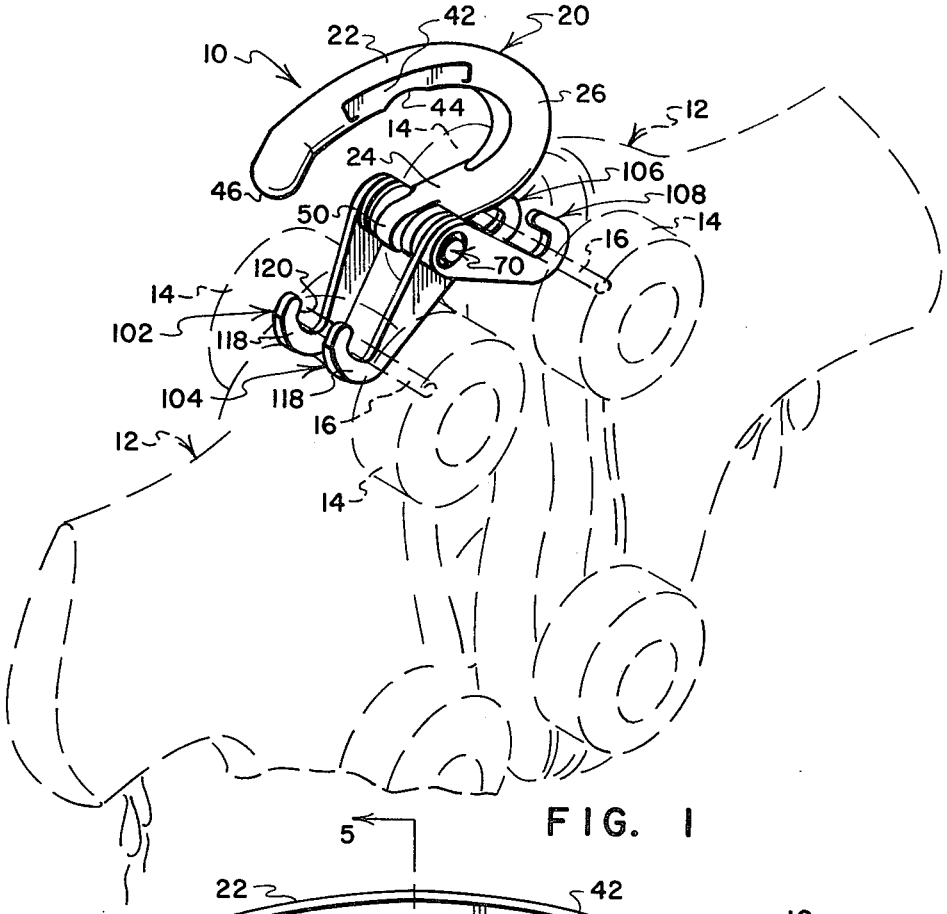
FIG. 1 is a perspective view showing a preferred embodiment of a roller skate carrier in receiving relationship with the rear axles of a pair of roller skates, the roller skates being illustrated in phantom.

Referring to FIG. 1, a roller skate carrier embodying the preferred practice of the present invention is indicated generally by the numeral 10. In FIG. 1, the carrier 10 is shown in receiving relationship with a pair of roller skates, the skates being shown in phantom and indicated generally by the numeral 12. The skates 12 have rear wheels 14 carried on rear axles 16. The carrier 10 has a C-shaped handle 20 which is connected by a shaft 70 to four hook-shaped arm members 102, 104, 106, 108. The arms 102, 104, 106, 108 grasp the skate axles 16 at locations just inside the inner surfaces of the rear wheels 14.

Referring to FIGS. 1–6, the C-shaped handle 20 has upper, lower and central portions 22, 24, 26 which overlie each other and which extend substantially in a common plane. The upper leg portion 22 is of sufficient size relative to the size of one's hand to effectively distribute the load of a pair of skates across the width of one's hand. A reinforcing rib 28 is provided on the inside of parts of the leg portions 22, 24, 26 to strengthen the handle 20.

Figure 5:
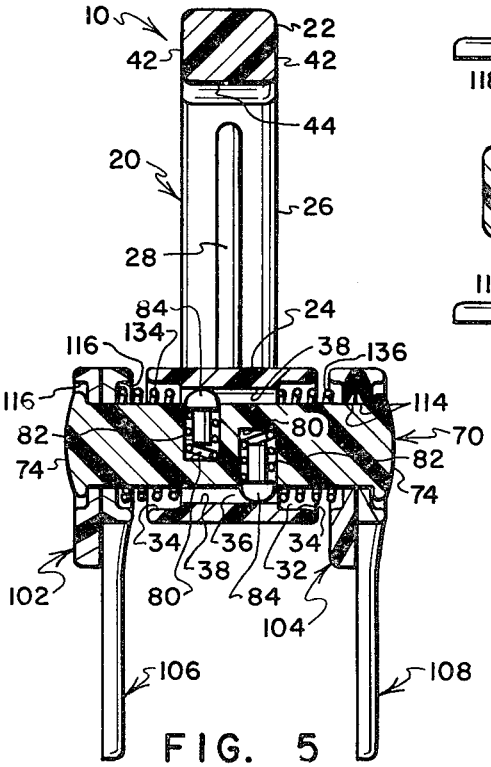
Figure 6:
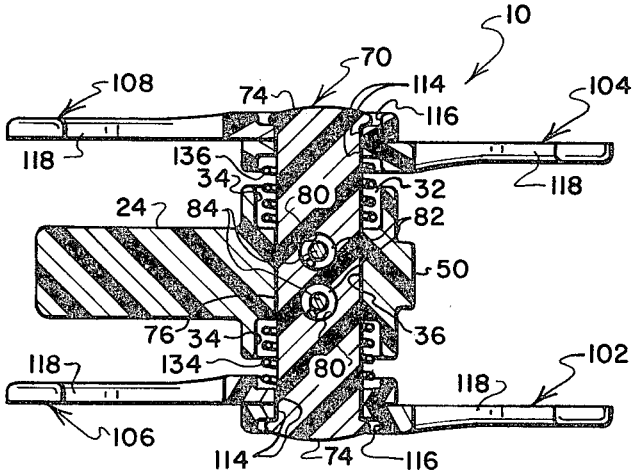
Figure 8:
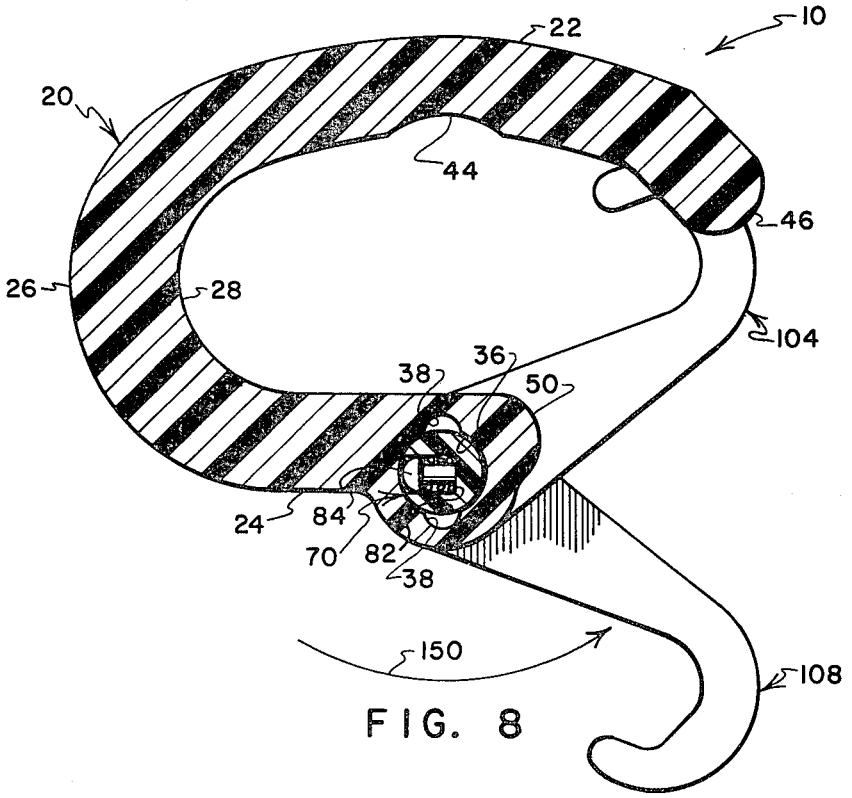
FIG. 8 is a sectional view similar to FIG. 7 showing the hook-arm members at an intermediate position during movement between their operative and storage positions.

The lower leg portion 24 has an opening 32 extending therethrough in directions substantially perpendicular to the common plane of the upper, lower and central portions 22, 24, 26. As is best seen in FIGS. 5 and 6, the opening 32 has enlarged diameter outer end regions 34, and a central region 36 of relatively smaller cross section. As is best seen in FIG. 8, the central region 36 is circular in cross section except where two longitudinally extending grooves 38 serve to enlarge upper and lower parts thereof.

Figure 2:
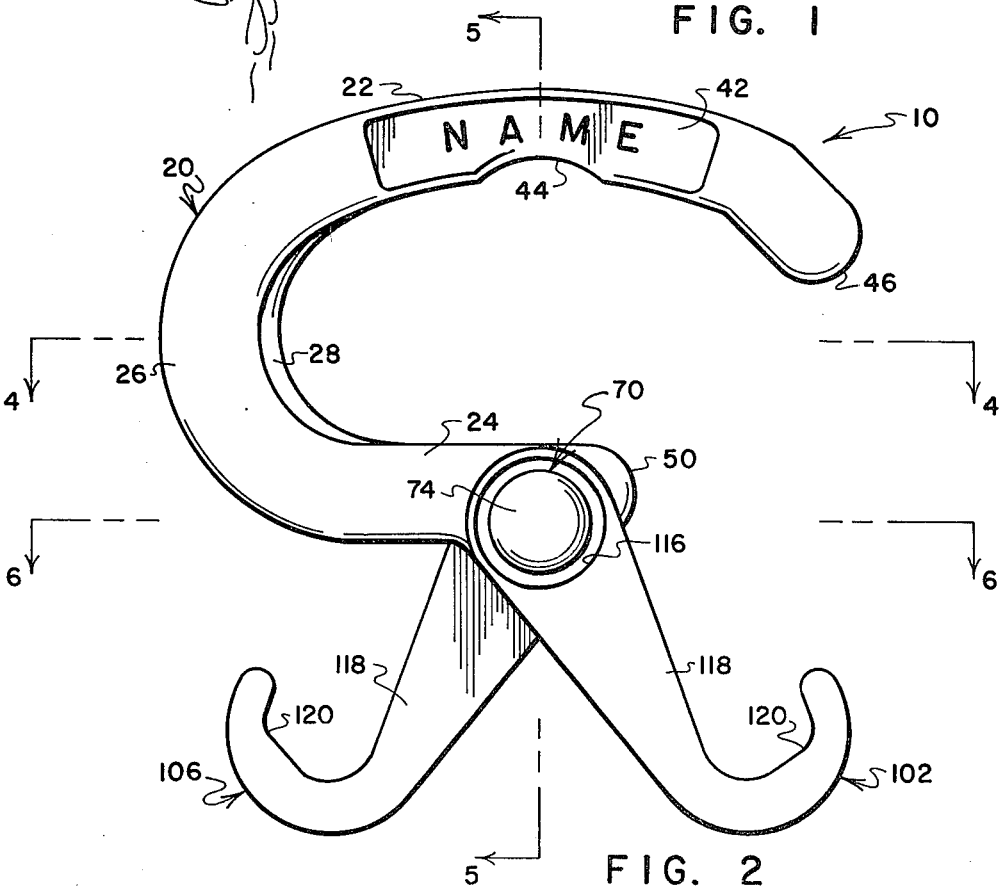
FIG. 2 is a front side elevational view, on an enlarged scale, of the carrier of FIG. 1.
Figure 3:
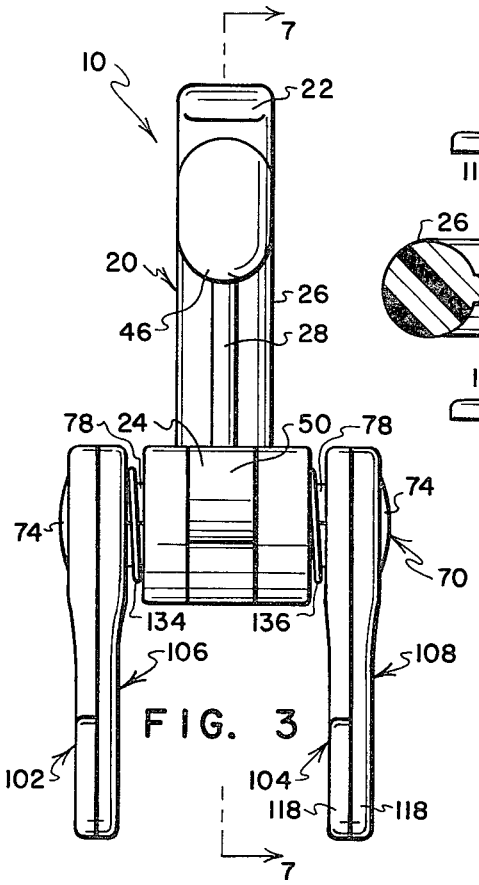
FIG. 3 is an end elevational view of the carrier of FIG. 1.
Figure 4:
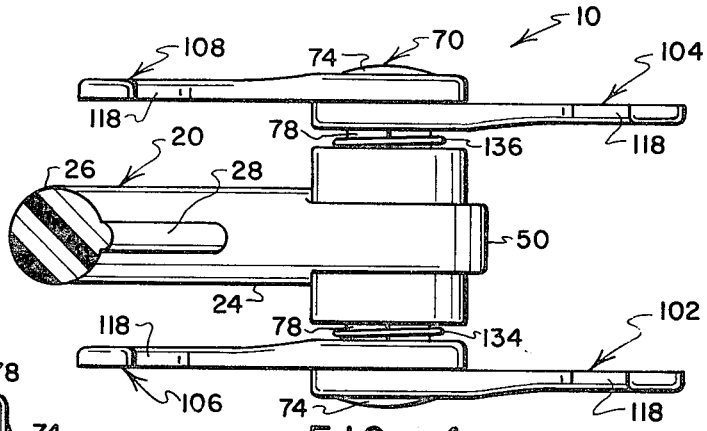
FIGS. 4, 5 and 6 are sectional views as seen from planes indicated by lines 4—4, 5—5 and 6—6 in FIG. 2.

A pair of flat surfaces 42 are provided on opposite sides of the upper leg portion 22 of the C-shaped handle 20 to provide regions onto which a suitable name or other imprint may be inscribed, as indicated by the letters "NAME" in FIG. 2. A notch 44 is formed in the underside of the upper leg portion 22 to facilitate hanging the carrier 10 on a coat rod, either by itself or while supporting a pair of skates 12. A rounded formation 46 is provided at the end of the upper leg portion 22. A rounded formation 50 is provided at the end of the lower leg portion 24.

Figure 9:
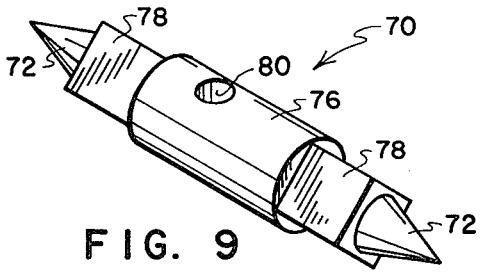
FIG. 9 is a perspective view of a shaft employed in the carrier of FIGS. 1–8, the shaft being shown in the configuration it assumes prior to the time when its ends are "staked" to hold the carrier parts in assembled relationship.
Figure 10:
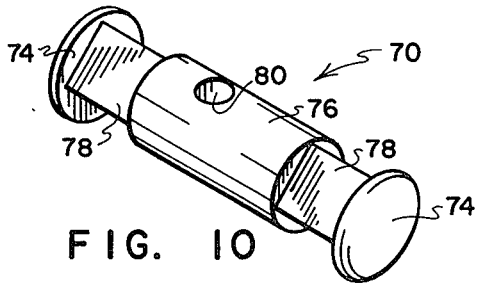
FIG. 10 is a perspective view similar to FIG. 9 of the shaft after its ends have been staked.

Referring to FIGS. 9 and 10, the shaft 70 is formed as a molded piece of thermoplastics material. Prior to its being assembled with other parts to form the carrier 10, the shaft 70 has conically tapered ends 72 shown in FIG. 9. Once the shaft 70 has been assembled with other parts to form the carrier 10, its tapered ends 72 are "staked" by heating and pressing them to form enlarged heads 74, as shown in FIG. 10. The shaft 70 has a cylindrical central region 76 which is configured to be journaled by the central region 36 of the handled hole 32. A pair of square formations 78 interconnect opposite ends of the central region 76 and the tapered ends 72 (or enlarged heads 74).

Figure 7:
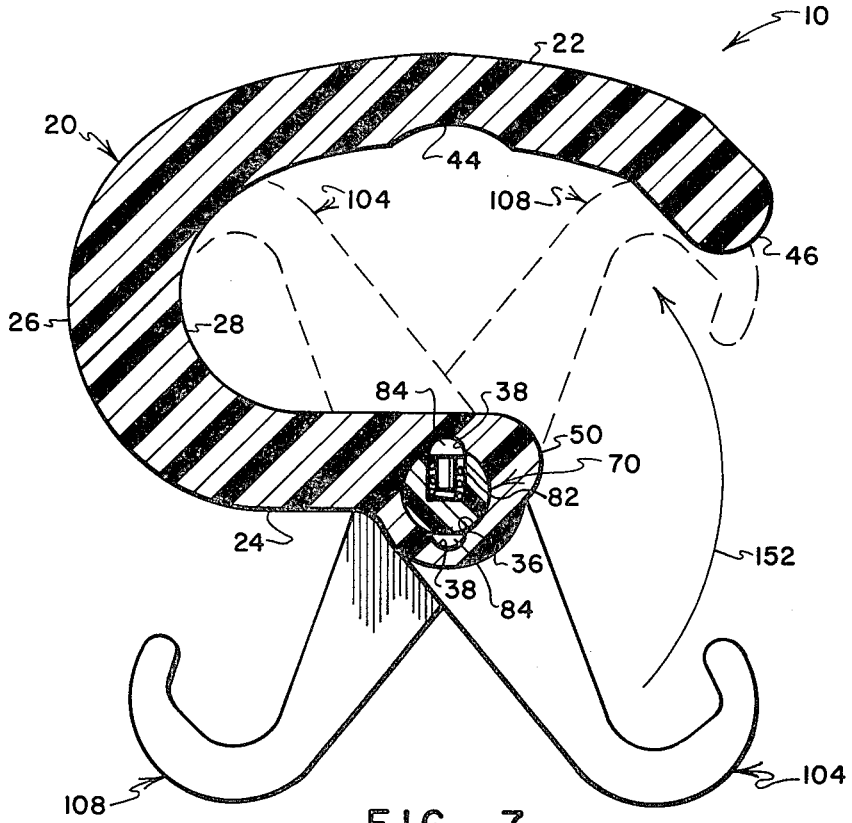
FIG. 7 is a sectional view as seen from a plane indicated by a line 7—7 in FIG. 3 with the hook-arm members of the carrier being shown in solid lines in their extended operative position, and shown in phantom in their retracted, storage position.

Referring to FIG. 5, a pair of radially extending holes 80 are formed in the central region 76 of the shaft 70 at spaced locations along its length. The holes 80 open through the cylindrical outer wall of the central region 76 on opposite sides thereof, and extend only part way through the shaft 70. A pair of compression coil springs 82 are carried in the holes 80, as are a pair of headed pins 84. The springs 82 bias the heads of the pins 84 radially outwardly with respect to the shaft 70. When the heads of the pins 84 align with the grooves 38, as is best seen in FIGS. 5 and 7, the springs 82 will bias the heads of the pins 84 into the grooves 38, whereby a double detent action is provided which will operate to inhibit relative rotation of the shaft 70 with respect to the handle 20. When the heads of the pins 84 do not align with the grooves 38, as best seen in FIG. 8, the pins 84 remain nested in the holes 80.

Figure 12:
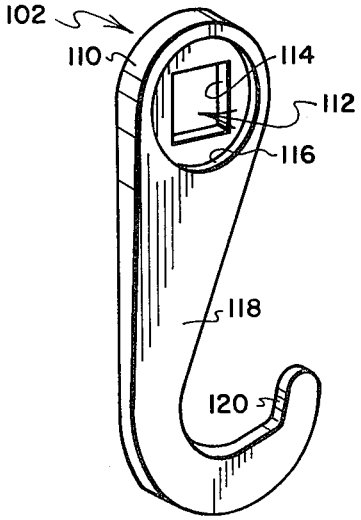

The hook-shaped arm members 102, 104, 106, 108 are identical in all respects one with another (there are no "lefts" or "rights"—all are the same). Referring to FIG. 12, each of the members 102, 104, 106, 108 has a central hub 110 through which a hole 112 extends. One end of the hole 112 is of square cross section, as indicated by the numeral 114. The square end portion 114 is configured to loosely receive one of the square shaft portions 78. The other end of the hole 112 is of enlarged cylindrical configuration, as indicated by the numeral 116.

Depending from the hub 110 is a hook-shaped projection 118 which defines a U-shaped opening 120. The opening 120 is configured to receive and grasp a rear skate axle 16, as shown in FIG. 1.

The hook-shaped arms 102, 104, 106, 108 are positioned on the square shaft portions 78 in pairs; the members 102, 104 are "outer" and "inner" members, respectively, which are located on opposite sides of the handle 20 and serve to grip spaced portions of one of the rear skate axles 16, as shown in FIG. 1; and, the members 106, 108 are "inner" and "outer" members, respectively, which are located on opposite sides of the handle 20 and serve to grip spaced portions of the other of the rear skate axles 16.

Referring to FIGS. 5 and 6, two compression coil springs 134, 136 are carried on the shaft 70 and serve to bias the arm members 102, 104, 106, 108 outwardly from the handle 20. The spring 134 has one end received in one of the hole portions 34 of the handle 20, and its other end in the hole portion 116 of the inner member 104. The spring 136 has one end received in the other of the hole portion 34, and its other end in the hole portion 116 of the inner member 106. By this mounting arrangement, all of the arm members 102, 104, 106, 108 are movable relative to each other and relative to the shaft 70, and the spacings between the pairs of arm members can be adjusted as needed to accommodate skates of a wide variety of sizes. The staked ends 74 of the shaft 70 are received in the hole portions 116 of the outer members 102, 108 to give the carrier 10 a smooth, pleasing appearance.

In operation, when a pair of skates 12 are to be transported or supported for storage, the hook-shaped ends of the arm members 102, 104, 106, 108 are positioned in their extended, operative position relative to the handle 20, as shown in solid lines in FIG. 7, and are inserted between the inner surfaces of the rear skate wheels 14 into grasping engagement with the rear axles 16, as shown in FIG. 1. The carrier 10 and the skates 12 may then be transported by grasping its upper leg portion 22. If the skates 12 are to be stored, the upper leg 22 of the handle 20 can be inserted over a conventional coat rod or coat hook to a position where such rod or hook is received in the groove 44.

If the carrier 10 is to be stored or transported without the skates 12 being carried thereon, the hook-shaped arm members 102, 104, 106, 108 are preferably moved to their storage position (shown in phantom in FIG. 7) by rotating the shaft 70, as is indicated by the arrows 150, 152 in FIGS. 8 and 7, respectively.

Figure 11:
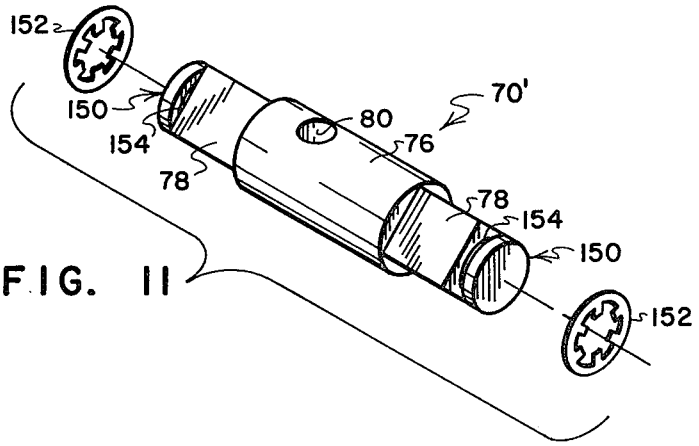
FIG. 11 is a perspective view of an alternate shaft embodiment together with a pair of retainer washers which may be utilized instead of staking the ends of the shaft embodiment shown in FIGS. 9 and 10 and, FIG. 12 is a perspective view of one of the hook-arm members.

Referring to FIG. 11, an alternate embodiment of the shaft 70 is indicated generally by the numeral 70'. The shaft 70' is identical with the shaft 70 except that, in place of the tapered ends 72 which are intended to be staked through heating, headed end formations 150 are provided for receiving a pair of retainer washers 152. Circumferentially extending grooves 154 are provided on the end formations 150. When the washers 152 are pressed onto the formations 150, they pass in interference fit over the enlarged outer ends and are received in the grooves 154 where they are retained. The washers 152 serve the same function as the staked heads 74 in retaining the parts of the carrier 10 in an assembled configuration.

A significant feature of the carrier 10 is that the spring biased pins 84 which are engageable with the grooves 38 provide a strong, relatively stiff, double-acting detent which will securely hold the members 102, 104, 106, 108 in their storage and operative positions. This doubleacting detent will assure that, when skates 12 are being carried, by the carrier 10, the shaft 70 will not oscillate as one's arm tends to move back and forth as one walks.

Still another significant feature is the entirely independent mounting of each of the arm members 102, 104, 106, 108 which renders the carrier 10 adjustable to receive skates of a wide variety of sizes.

Although the invention has been described in its preferred form with a cetain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A roller skate carrier, comprising:

(a) a handle having a hole formed therethrough;

(b) a shaft journaled in the hole and having opposed end regions projecting from opposite sides of the handle;

(c) four separately formed, substantially identically configured arm members carried on the shaft end regions and being drivingly connected thereto for rotation concurrently therewith, two of these arm members being located relatively inwardly near the handle, and the remaining two of the arm members being located relatively outwardly at farther distances from the handle;

(d) retaining means near opposite ends of the shaft for retaining the arm members on the shaft;

(e) biasing means interposed between the handle and between the inner arm members for biasing the inner arm members relatively away from the handle toward positions of engagement with the outer arm members, and for biasing the outer arm members toward positions of engagement with the retaining means;

(f) one of the inner arm members on one side of the handle and the outer arm member which is located on the opposite side of the handle having a pair of overlying hook-shaped formations configured to receive and grasp spaced portions of a rear axle of a skate;

(g) the other of the inner and outer arm members having a pair of hook-shaped formations configured to receive and grasp spaced portions of a rear skate axle of another skate; and, (h) the arm members being slip-fitted onto the shaft end regions to enable the arm members to move independently relative to each other and relative to the shaft in directions axial of the shaft to permit the carrier to be used with skates of a wide variety of sizes.

2. The skate carrier of claim 1 wherein a first radially extending hole is provided in the shaft at a location where the shaft passes through the handle, a first axially extending groove is formed in the handle for alignment with the first shaft hole when the shaft is positioned to orient the arm members in a depending, operative position with respect to the handle, and first spring-biased detent means is carried in the first shaft hole for projection into the first groove to inhibit the shaft from moving the arm members out of their operative position once the arm members have been positioned therein.

3. The skate carrier of claim 2 wherein a second groove is provided along the shaft hole on the opposite side thereof from the first groove for receiving the first spring-biased detent means when the shaft is rotated to a storage position wherein the arm members overlie opposite sides of the handle.

4. The skate carrier of claim 3 wherein a second radially-extending hole is formed in the shaft at a location spaced from the first hole, the second hole paralleling the first hole but opening through the opposite side of the shaft from the first hole, and a second spring-biased detent means is carried in the second hole for engaging the first and second grooves when the shaft is positioned in either of the described positions.

5. A carrier for releasably receiving, retaining, and carrying a pair of roller skates comprising:

(a) a substantially C-shaped member having upper and lower leg portions which overlie each other and which extend substantially in a common plane;

(b) the upper leg portion being of sufficient size relative to the size of one's hand to effectively distribute the load of a plurality of a pair of roller skate hangers across the width of one's hand;

(c) mounting means connecting four individual hook-shaped arms to the lower leg portion, the arms being configured to releasably receive and retain rear axles of a pair of roller skates with the skates extending substantially within said common plane; and, (d) the mounting means including a shaft which extends through a hole formed in the lower leg portion and which drivingly interconnects all four of the arms for concurrent rotation therewith, retaining means holding the arms on the shaft while permitting axial movement of the arms along the shaft, and biasing means biasing the arms relatively away from the lower leg portion toward the ends of the shaft.

6. The carrier of claim 5 wherein the C-shaped member has at least one flat surface portion formed thereon for receiving a name inscription.

7. The carrier of claim 5 wherein notch means is provided in the lower surface of the upper leg portion for facilitating hanging the carrier on a conventional closet rod with the rod received in the notch means.

8. The carrier of claim 5 wherein:

(a) the arms are substantially indentically configured;

(b) two of the arms being located relatively inwardly with respect to the handle, and the rmaining two arms being located relatively outwardly at further distances from the handle;

(c) one of the inner arm members on one side of the handle and the outer arm member which is located on the opposite side of the handle having a pair of overlying hook-shaped formations configured to receive and grasp spaced portions of a rear axle of a skate; and, (d) the other of the inner and outer arm members having a pair of hook-shaped formations configured to receive and grasp spaced portions of a rear skate axle of another skate.

9. The skate carrier of claim 5 wherein a first radially extending hole is provided in the shaft at a location where the shaft passes through the handle, a first axially extending groove is formed in the handle for alignment with the first shaft hole when the shaft is positioned to orient the arm members in a depending, operative position with respect to the handle, and first spring-biased detent means is carried in the first shaft hole for projection into the first groove to inhibit the shaft from moving the arm members out of their operative position once the arm members have been positioned therein.

10. The skate carrier of claim 9 wherein a second groove is provided along the shaft hole on the opposite side thereof from the first groove for receiving the first spring-biased detent means when the shaft is rotated to a storage position wherein the arm members overlie opposite sides of the handle.

11. The skate carrier of claim 10 wherein a second radially-extending hole is formed in the shaft at a location spaced from the first hole, the second hole paralleling the first hole but opening through the opposite side of the shaft from the first hole, and a second spring-biased detent means is carried in the second hole for engaging the first and second grooves when the shaft is positioned in either of the described positions.

* * * * *